US005775033A

United States Patent [19]

Meehan

[11] Patent Number: 5,775,033

[45] Date of Patent: Jul. 7, 1998

[54] BUILDING STRUCTURE COMPRISING A COMBINED ENCLOSED RESTAURANT AND AMUSEMENT AREA HAVING A VIEWING PANE THEREBETWEEN

[75] Inventor: Paula Kent Meehan, Beverly Hills, Calif.

[73] Assignee: Kenquest, Inc., Beverly Hills, Calif.

[21] Appl. No.: 699,966

[22] Filed: Aug. 20, 1996

[51] Int. Cl.[6] ..... E04H 3/04

[52] U.S. Cl. ..... 52/33; 186/38

[58] Field of Search ..... 52/6, 33, 234; 186/35, 36, 38–51, 53

[56] References Cited

U.S. PATENT DOCUMENTS

| | | | |
|---|---|---|---|
| 3,002,233 | 12/1961 | Obata | 20/1.12 |
| 4,074,793 | 2/1978 | Yuter | 186/38 |
| 4,274,233 | 6/1981 | Currier | 52/33 |
| 4,574,547 | 3/1986 | Menchetti et al. | 52/238.1 |
| 5,140,792 | 8/1992 | Daw et al. | 52/238.1 |
| 5,193,648 | 3/1993 | Yuter | 186/38 |

*Primary Examiner*—Carl D. Friedman
*Assistant Examiner*—Cynthia Smith
*Attorney, Agent, or Firm*—Jeffer, Mangels, Butler & Marmaro LLP

[57] ABSTRACT

The present invention provides a building structure within which a setting is maintained which allows restaurant patrons to enjoy dining out while allowing primarily children accompanying adult patrons the opportunity of playing in an adjacent amusement area without disturbing the adult patrons. The adult patrons, however, can view the children and any other amusement area patrons, allowing monitoring of the children's activity while simultaneously enjoying the view of the children at play and enjoying their meal. Preferably sound proofing is disposed between the two areas. Additionally, other areas, such as an exercise area, a play area, a coffee shop, gift shop, art projection area and the like can be contained within the building structure.

31 Claims, 7 Drawing Sheets

BUILDING STRUCTURE COMPRISING A COMBINED ENCLOSED RESTAURANT AND AMUSEMENT AREA HAVING A VIEWING PANE THEREBETWEEN

BACKGROUND OF THE INVENTION

The present invention relates to a building structure which comprises a restaurant and an amusement area arranged such that restaurant patrons can easily view the amusement area while dining.

Previous building structures which provide for diversity of use have included arrangements as described in a number of U.S. patents. Currier, U.S. Pat. No. 4,274,233 discloses a building layout for a combined restaurant and artists work area. Restaurant patrons can view the artists at work, however, provision for the separation of the artist's areas and the dining area by the interposition of a viewing pane adjacent a structural member common to both areas is not taught or suggested by Currier. Yuter, U.S. Pat. No. 5,193,648 discloses a restaurant construction system whereby an order-taking person at an order-taking post can see a patron at a table located on a lower terraced level. Obata, U.S. Pat. No. 3,002,233 discloses an auditorium which can be used as a single large space or partitioned into several smaller spaces through the use of movable partition walls.

SUMMARY OF THE INVENTION

The present invention provides a building structure within which a setting is maintained which allows restaurant patrons to enjoy dining out while allowing primarily children accompanying the adult patrons the opportunity of playing in an adjacent play center without disturbing the adult patrons. The adult patrons, however, can view the children and any other amusement area patrons, allowing monitoring of the children's activity while simultaneously enjoying the view of the children at play and enjoying their meal.

In one embodiment there is provided a building structure which houses a restaurant and an amusement area, comprising an enclosed space defining a dining area, further comprising a doorway for access thereto, an enclosed space defining an amusement area, further comprising a doorway for access thereto and a viewing pane disposed adjacent a wall common to the dining area and the amusement area, whereby patrons of the dining area can view the amusement area.

In another embodiment the building structure further comprises an enclosed space defining a food preparation area accessible to the dining area.

In a further embodiment a second viewing pane is provided.

In another embodiment the viewing pane disposed adjacent a wall common to the dining area and the amusement area comprises a surface area in a range of from about 20% to about 100% of a surface area of the common wall.

In still another embodiment the viewing pane disposed adjacent a wall common to the dining area and the amusement area comprises a surface area in a range of from about 20% to about 50% of a surface area of the common wall.

In still another embodiment the viewing pane disposed adjacent a wall common to the dining area and the amusement area comprises a surface area in a range of from about 50% to about 100% of a surface area of the common wall.

In one embodiment sound proofing material is disposed adjacent the dining area and the amusement area.

In another embodiment of the building structure the enclosed space defining a dining area further comprises movable walls disposed between a first dining area and a second dining area. A movable wall can be disposed between the dining area and a coffee shop area.

In a further embodiment a means of access between the enclosed space defining a dining area and the enclosed space defining an amusement area is provided.

In one embodiment of the building structure the doorway for access to the space defining an amusement area houses a revolving door.

In another embodiment the amusement area can further include video games.

In another embodiment the amusement area can further include means for engaging in a virtual reality experience.

In another embodiment the amusement area can include one of any or all of: a non-video game, a toy, an amusement park ride, a climbing structure which can further be resilient to allow for bouncing. The amusement area can further include a tunnel, a video game and a means for engaging in a virtual reality experience.

In one embodiment there is provided a building structure which comprises: a) a first structural member enclosing a food preparation area, a dining area, an amusement area, and a lobby area, the lobby area in communication with an exterior of the building structure; b) a doorway in communication with the amusement area disposed adjacent a second structural member interposed between the lobby area and the amusement area, the amusement area including an amusement park ride housed therein; c) a third structural member interposed between the dining area and the amusement area; d) a doorway disposed adjacent the first structural member; e) a second doorway disposed adjacent the third structural member; and f) and a viewing pane disposed adjacent the third structural member interposed between the dining area and the amusement area; whereby patrons of the dining area can view the amusement area.

In one embodiment of the invention the amusement area can contain permanent or semi-permanent amusement park type rides, e.g. an astronaut ride, a jet plane ride.

In another embodiment the building structure further comprises a second viewing pane.

In yet another embodiment the building structure with a viewing pane disposed adjacent a third structural member interposed between a dining area and an amusement area comprises a surface area in a range of from about 20% to about 100% of a surface area of the third structural member.

In still another embodiment the building structure with a viewing pane disposed adjacent a third structural member interposed between a dining area and an amusement area comprises a surface area in a range of from about 20% to about 50% of a surface area of the third structural member.

In still another embodiment the building structure with a viewing pane disposed adjacent a third structural member interposed between a dining area and an amusement area comprises a surface area in a range of from about 50% to about 100% of a surface area of the third structural member.

In another embodiment the building structure further comprises a doorway disposed adjacent the third structural member interposed between the dining area and the amusement area.

In a further embodiment the building structure further comprises a gift shop and a coffee shop which can be combined or separate.

In yet another embodiment the building structure further comprises a stage adjacent the amusement area.

In still another embodiment the building structure further comprises sound proofing material disposed adjacent the dining area and the amusement area.

In one embodiment the building structure having an enclosed space defining a dining area further comprises movable members disposed between a first dining area and a second dining area.

In another embodiment the building structure wherein a doorway in communication with the amusement area disposed adjacent a second structural member interposed between the lobby area and the amusement area comprises a revolving door.

In another embodiment the amusement area can further include video games.

In another embodiment the amusement area can further include means for engaging in a virtual reality experience.

In another embodiment the amusement area can include one of any or all of: a non-video game, a toy, an amusement park ride, a climbing structure which can further be resilient to allow for bouncing thereon. The amusement area can further include a tunnel, a video game and a means for engaging in a virtual reality experience.

Other features and advantages of the invention will become apparent from the following detailed description, taken in conjunction with the accompanying drawings which illustrate, by way of example, various features of preferred embodiments of the invention.

BRIEF DESCRIPTION OF THE FIGURES

The detailed description of the invention will be made with reference to the accompanying drawings, where like numerals designate corresponding parts of the figures.

DETAILED DESCRIPTION OF THE INVENTION

It is to be understood that the Figures are illustrative of only one particular embodiment of the present invention and other configurations of areas or the nature of types of areas and/or particular combinations of amusement rides, games and the like are within the contemplation of the present invention.

Figure 1:
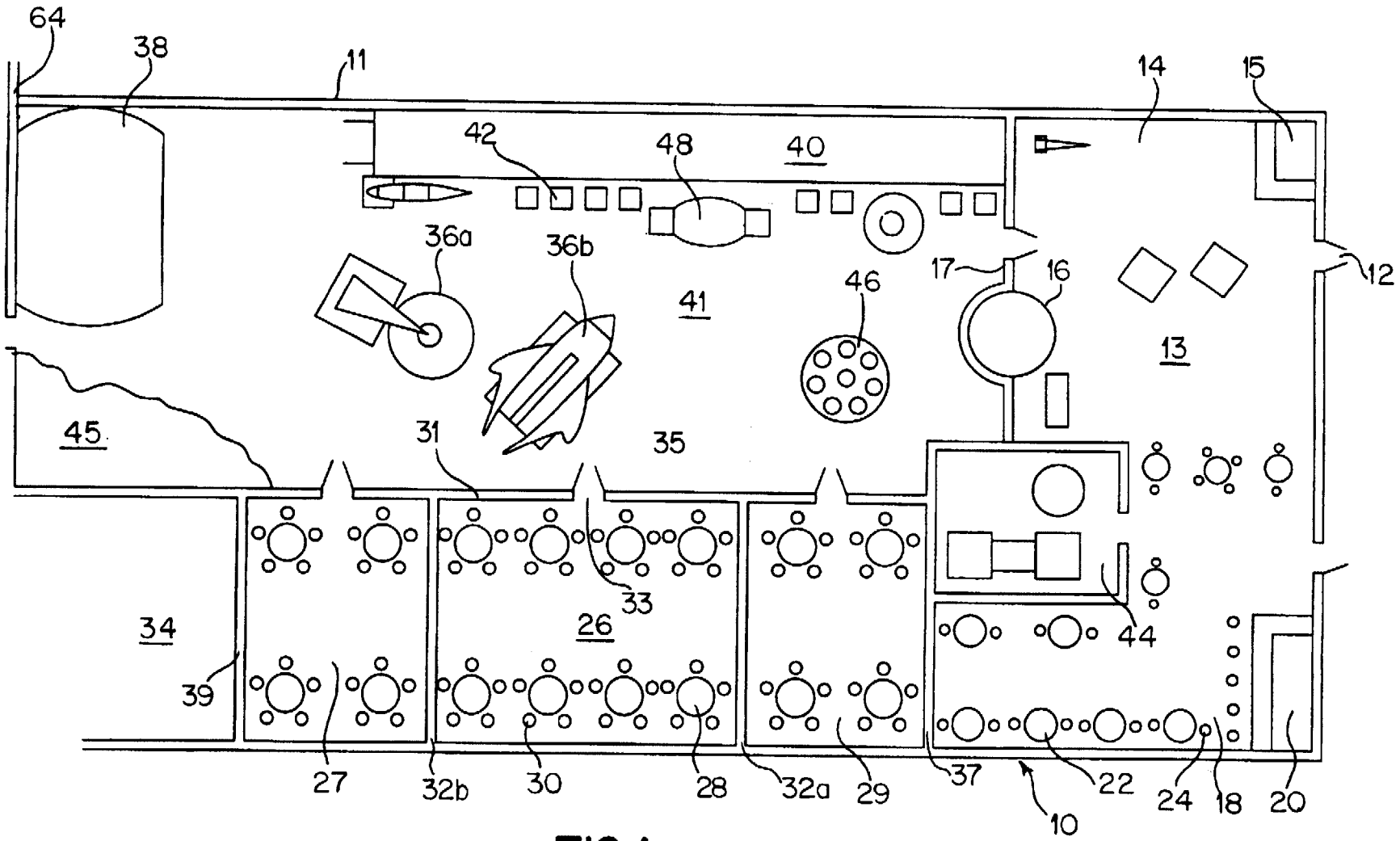
FIG. 1 illustrates one particular embodiment of a layout of the building structure of the present invention.

FIG. 1 illustrates a building structure 10, having a doorway 1 2 allowing access from an exterior of building structure 10 to a lobby area 13. Building structure 10 includes a first structural member 11 enclosing a food preparation area 34, a dining area 26, an amusement area 41, and a lobby area 13. First structural member 11 includes a wall or walls and a roof within which the designated areas are located. The wall or walls and roof can define any shape including but not limited to a cube, a pyramid, a geodesic dome, a cylinder, a rectangular prism or combinations thereof. The wall or walls and roof can be formed of different structural elements which are joined as is known in the building arts. They can be constructed on site or off site and transported to the location at which the building structure will be erected. The first structural member accordingly encompasses any structure or technique as is known in the building arts for enclosing an interior space comprised of separate functional areas. In one embodiment first structural member 11 along a length enclosing amusement area 41 is substantially opaque. First structural member 11 can enclose fewer areas or more areas than set forth above.

Lobby area 13 is an area adjacent an exterior of building structure 10 through which access to one or more others areas can be gained. Lobby area 13 is accessible to an exterior of building structure 10 such that lobby area 13 either directly or indirectly allows one to exit building structure 10.

A gift shop 14, containing a gift shop counter 15 can be accessed through lobby area 13 or through a rocket slide 40 disposed within an amusement area 41. The terms "gift shop" and "coffee shop" are used as commonly defined. There can be a play area disposed adjacent coffee shop 18. In a further embodiment there can be an exercise area 44 adjacent coffee shop 18. Gift shop 14 and/or coffee shop 18 can be disposed adjacent to lobby area 13. Coffee shop 18 can contain a counter 20, tables 22 and chairs 24 is located adjacent lobby area 13.

A second structural member 17 can be disposed between lobby area 13 and amusement area 41. A revolving doorway 16 disposed adjacent second structural member 17 can allow for access between lobby area 13 and amusement area 41. Revolving door 16 can be in one aspect, for example, a standard revolving door with multiple partitions. In a specific embodiment a curved member bridging an entrance to an area can be rotated to allow entrance and/or exit to the area, somewhat similar to those devices which allow access to and from a darkroom without allowing light to enter.

Second structural member 17 is similar to first structural member 11, differing in that a roof is not considered an element of second structural member 17 and second structural member 17 encompasses any structure or technique as is known in the building arts for dividing an interior space comprised of separate functional areas. A doorway 37 provides access to dining area 26, which contains tables 28 and chairs 30. Door 33 provides access to and from amusement area 41, through a third structural member 35. Third structural member 35 interposed between dining area 26 and amusement area 41 is, for example, a wall separating these areas. The definition given for second structural member 17 applies to third structural member 35. However, in some embodiments, a viewing pane 31 can comprise about 100% of the surface area of third structural member 35, accordingly the definition as to viewing pane 31 would then apply to third structural member 35. Further, the third structural member can span more than one story of building structure 10, either contiguously or by position above or below third structural member 35 on a given story of a multi-story structure. Such a third structural member is still a wall in common between two areas, such as dining area 26 and amusement area 41.

A viewing pane 31 allows for monitoring of amusement area 41 from dining area 26 and vice versa. The viewing pane 31 can be disposed adjacent third structural member 35 interposed between dining area 26 and amusement area 41 to permit one to look from one area to the other. Viewing pane 31 can be a single aperture or multiple apertures in third structural member 35 between the two areas. Preferably, a material is interposed between the two areas within the aperture or apertures to allow for viewing. The material is preferably transparent, however, translucent materials or non-opaque materials or combinations thereof are within the scope of the invention so long as some images are visible from one area to the next. Viewing pane 31 interposed between dining area 26 and amusement area 41 can particularly comprise various materials such as glass, plastic or other transparent substances as are in compliance with any relevant building regulations. The materials can be optically neutral and transmit the image from one area to the next substantially unaltered or the materials can enlarge, diminish or distort the images transmitted from one area to the other. In a particular embodiment, one way mirrors or glass can be utilized. Viewing pane 31 can comprise the entirety of a common wall between dining area 26 and amusement area 41. Alternatively, viewing pane 31 can comprise some lesser area thereof. The shape of viewing pane 31 is not limited to any particular geometric shape or any combination of geometric shapes.

A second viewing pane can be provided in addition to a first viewing pane regardless of size or shape, except where the first viewing pane comprises 100% of the surface area of a structural member interposed between the dining area 26 and amusement area 41. The second or additional viewing pane can be of the same size and shape or different size and shape from the first viewing pane or from each other. In one embodiment, the size of the viewing pane or panes is not limited to any particular range of the surface area of an area perpendicular to and in common between the border of dining area 26 and amusement area 41. So long as a view of one area from the other is available, it is within the scope of the present invention. In a preferred embodiment, one can view substantially all of one area from substantially anywhere in the other area.

In one embodiment, the viewing pane can comprise a surface area in a range of from about 20% to about 100% of a surface area of the third structural member such that about 20% to about 100% of the surface area, as measured by, for example, multiplying the height by the width of, for example, a wall in common between the border of the dining area and amusement area, and which can be load bearing or not, comprises material which allows for a view from the dining area to the amusement area and vice versa.

In another embodiment, the viewing pane can comprise a surface area in a range of from about 20% to about 50% of a surface area of the third structural member such that about 20% to about 50% of the surface area, as measured by, for example, multiplying the height by the width of, for example, a wall in common between the border of the dining area and amusement area, and which can be load bearing or not, comprises material which allows for a view from the dining area to the amusement area and vice versa.

In yet another embodiment, the viewing pane can comprise a surface area in a range of from about 50% to about 100% of a surface area of the third structural member such that about 50% to about 100% of the surface area, as measured by, for example, multiplying the height by the width of, for example, a wall in common between the border of the dining area and amusement area, and which can be load bearing or not, comprises material which allows for a view from the dining area to the amusement area and vice versa.

In one embodiment viewing pane 31 can be located on a different level, for example the second or higher story of a structure, and allow for viewing of an area located on a lower or higher story.

Movable members **32*a* and 32*b* allow the dining area to be partitioned into more than one area such as areas 27 and 29. In a preferred embodiment the dining area can be partitioned into three sections. The movable members 32*a* and 32*b* can contain elements permanently affixed to some area of the dining room such as a floor, a wall a ceiling or the like and can slide, roll, compress and expand or otherwise be movable such that the dining area can be partitioned. Alternatively, the entire movable member 32*a* and/or 32*b* can be carried into place where it acts to partition or can be moved into place and can slide, roll, compress and expand or otherwise be further movable such that the dining area can be partitioned. Such means would be known to those of ordinary skill in the art. In one embodiment of the present invention a movable member 32*a* and/or 32*b* can be disposed adjacent dining area 26 and coffee shop 18**.

An enclosed space defining a food preparation area 34 is accessible to a dining area through a door 39. The food preparation area 34 is an area where food can be prepared such as a kitchen, a barbecue grill area and the like. Generally a kitchen will contain running water, a sink(s), an oven(s), a refrigerator(s), food preparation utensils, and means for storing those utensils, food supplies and means for storing those supplies and the like. In a preferred embodiment the kitchen is suited to the commercial demands of a restaurant. The dining area 26 is an area containing; for example, but not limited to, counters, tables or tables and chairs and counters and stools, where food is served. Non-traditional dining areas, from a Western perspective, such as, but not limited to, the Japanese style where one sits on the floor are within the contemplation of this invention. The amusement area 41 is an area containing any one of a non-video game, a toy, an amusement park ride, a climbing structure which can further be resilient to allow for bouncing thereon. Further, the amusement area can include a tunnel, a video game and a means for engaging in a virtual reality experience. In a preferred embodiment a number of permanent or semi-permanent amusement park type rides, e.g. an astronaut ride, a jet plane ride and a number of video and non-video games are contained within the amusement area. Such amusement park rides can be obtained from commercial suppliers as would be readily ascertainable. Alternatively or additionally, custom rides can be created for use in the amusement area. These custom rides can be combinations of commercially available components or can be entirely fabricated according to custom specifications. In preferred embodiments the amusement area is enclosed and separated from other areas within the building structure, apart from access means; such as, but not limited to doors. The doorway in communication with amusement area 41 provides a means of entering and exiting amusement area 41. The doorway can or need not contain a door. The door can be a conventional door or a revolving door or other doors as are known in the art. The door can be opaque, semi-opaque or transparent. However, the interior of amusement area 41 is preferably easily viewable from at least dining area 26, as described in greater detail above. In a most preferred embodiment, the amusement area is accessible through a traditional revolving door. In a specific embodiment a curved member bridging an entrance to the amusement area can be rotated to reveal the entrance, somewhat similar to those devices which allow access to and from a darkroom without allowing light to enter.

In one embodiment sound proofing material can be added to the structural members enclosing the amusement area and/or the structural members themselves can have sound proofing properties. For example, the sound proofing material can be either directly incorporated in or on, in whole or in part, the third structural member interposed between dining area 26 and amusement area 41 and can be disposed in and around additional areas, if necessary, such as the ceiling, other internal walls and the like. Sound proofing materials are materials that either are generally used building materials used to the extent that the sound level of the amusement area is dampened so as not to interfere with normal conversation, or specially designed sound proofing materials as would be known to those of ordinary skill in the building arts can be used for a similar purpose, or a combination thereof can be used.

In one embodiment access to amusement area 41 can be provided by access means connecting dining area 26 and amusement area 41. In another embodiment access can be provided only directly to amusement area 41 or from another area which is not dining area 26, such as lobby area 13. In another embodiment access can be provided by any combination of the above. For example, as illustrated in FIG. 1, there is provided an enclosed space defining an amusement area 41 which furthers comprises a doorway for access thereto. Amusement area 41 contains amusement rides 36*a* and 36*b*, video games 42, a moonwalk bounce ride 46, a stage 48 and a mine area 45. The video games include electronic entertainment games with a video display which allow for interaction with the video display by some type of control means, for example, driving a car, flying a jet, shooting at objects and the like. In one embodiment a multiple screen display, for example, three screens, can display images of, for example, a rocket launch and a journey to the planets. A seat positioned to view the screens can be movable to simulate a feeling of motion, preferably in accordance with the image or images displayed on the screens. Such video games can be obtained from commercial suppliers as would be readily ascertainable. Alternatively, custom video games can be created for use in the amusement area. These custom video games can be combinations of commercially available components or can be entirely fabricated according to custom specifications. The means for engaging in a virtual reality experience include equipment such as a visored helmet which contains a video display and or gloves and/or a full body suit which contain sensors that allow for the representation of actions made by a person wearing such equipment on the video display. The result of wearing this equipment is the sensation of engaging in an activity in a highly realistic way, such as, storming a castle, while in actuality the person is merely sitting in a room. This term also encompasses all definitions as are in common usage. Further, the means for engaging in a virtual reality experience are not meant to be limited to existing technologies, but any means which provide for a virtual reality experience which can be developed. Such means for engaging in a virtual reality experience can be obtained from commercial suppliers as would be readily ascertainable. Alternatively or additionally, custom means for engaging in a virtual reality experience can be created for use in the amusement area. These custom means for engaging in a virtual reality experience can be combinations of commercially available components or can be entirely fabricated according to custom specifications.

The stage 48 can be adjacent amusement area 41 and provides an area or a platform for musical, dramatical, theatrical or dance performances and the like and is located in or is viewable from amusement area 41, and preferably also the dining area. Mine area 45 can contain objects such as costume jewelry or faux jewels, and toy creatures such as spiders, which can be available for sale in a gift shop area. An exercise area 44 is accessible to the amusement area through a doorway 47, which can be slidable. An art projector area 38 having a projection surface 64, as further described in FIG. 5 can be provided.

In one embodiment of the present invention, dining area 26 or another area can be located on a second or higher story of building structure 10. The viewing panes can still allow for a view of one area from another area, even when such areas are on different stories from each other.

Figure 2:
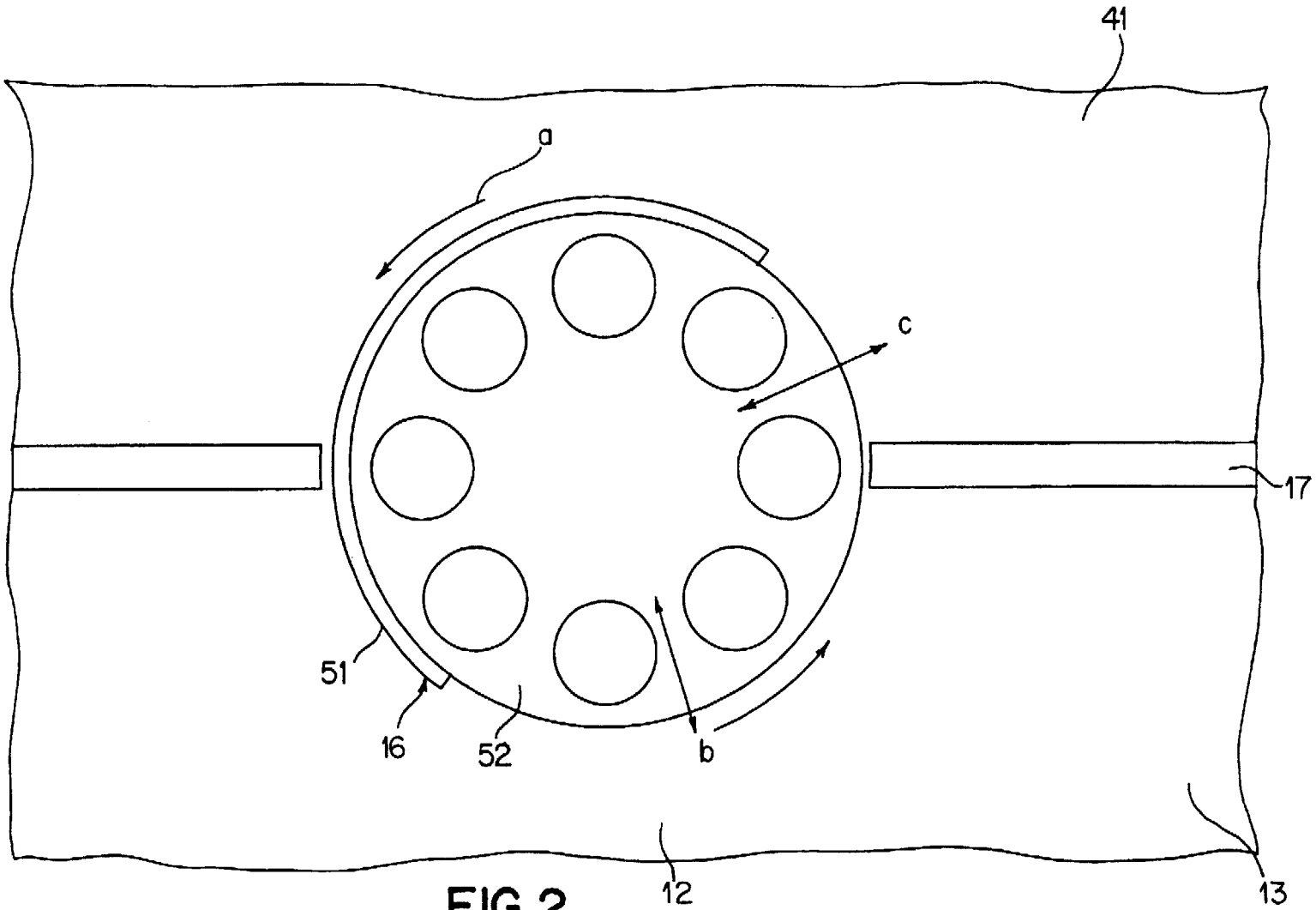
FIG. 2 illustrates a particular embodiment of a rotatable doorway of the present invention.

FIG. 2 illustrates a particular embodiment of a rotatable doorway 16 having a rotatable side member 51 and a top member 52, which allows access from lobby area 13, in communication with doorway 12, to amusement area 41, through second structural member 17 disposed between lobby area 13 and amusement area 41. Arrows b and c illustrate access routes to and from amusement area 41 and lobby area 13. Arrow a illustrates a direction of rotation of rotatable door 16. Rotation in the opposite direction is within the scope of the present invention.

Figure 3:
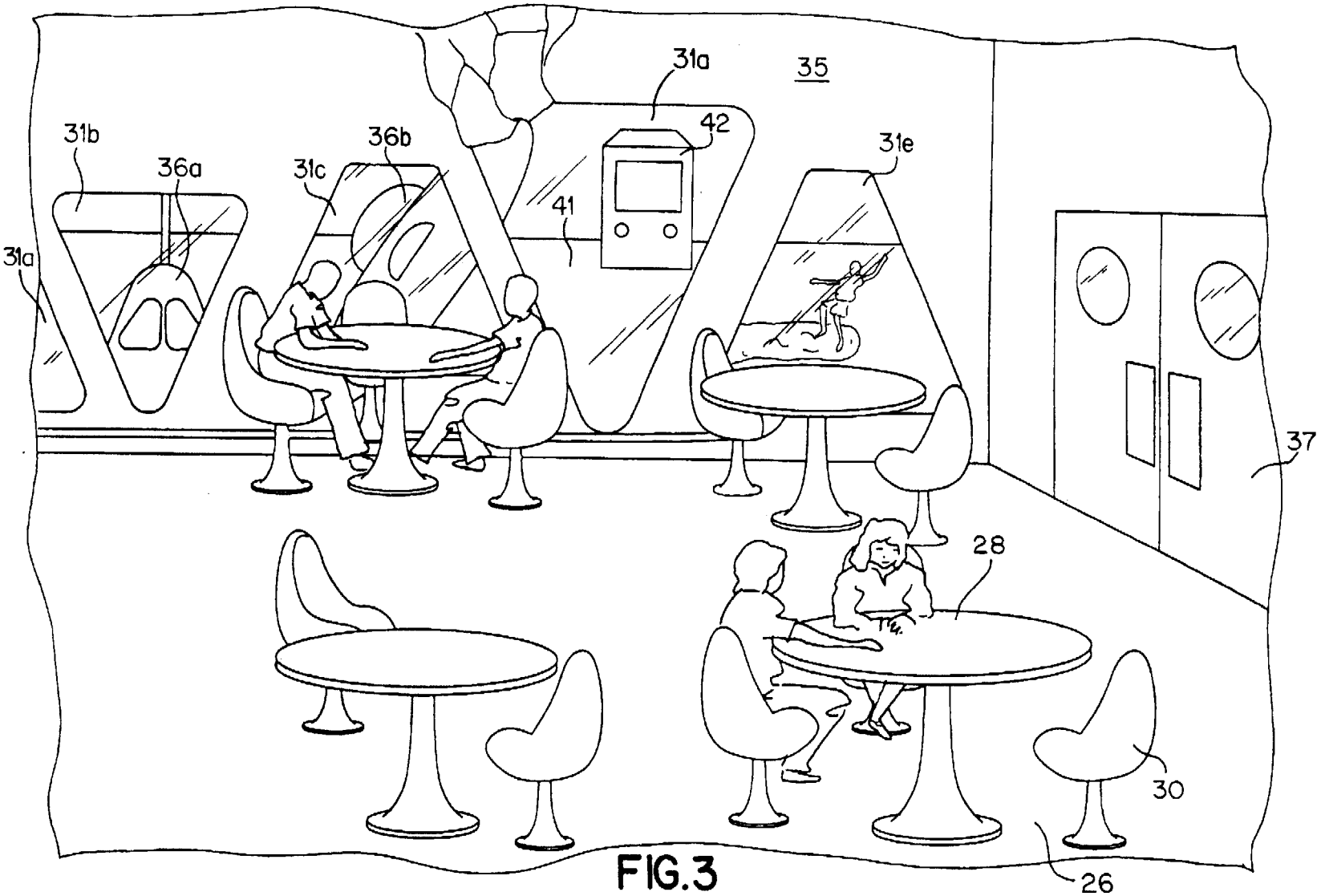
FIG. 3 illustrates a particular embodiment of a viewing pane of the present invention.

FIG. 3 illustrates dining area 26 containing tables 28 and chairs 30. Amusement area 41 containing video game 42 and amusement rides 36*a* and 36*b* are visible through multiple viewing panes 31*a–e*.

Figure 4:
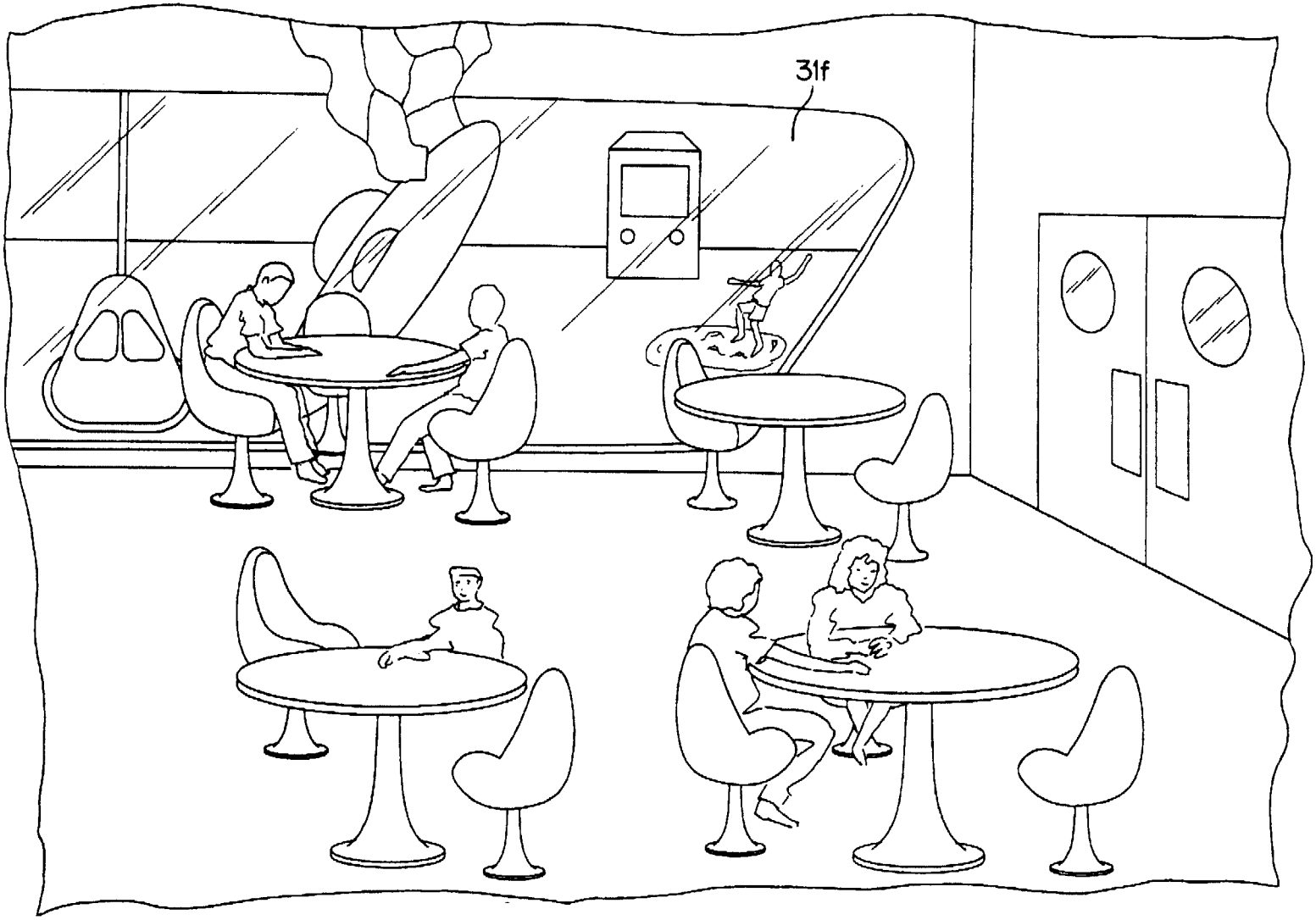
FIG. 4 illustrates another embodiment of a viewing pane of the present invention.

FIG. 4 is similar to FIG. 3, however it illustrates another embodiment of the present invention, comprising a single larger viewing pane 31*f*.

Figure 5:
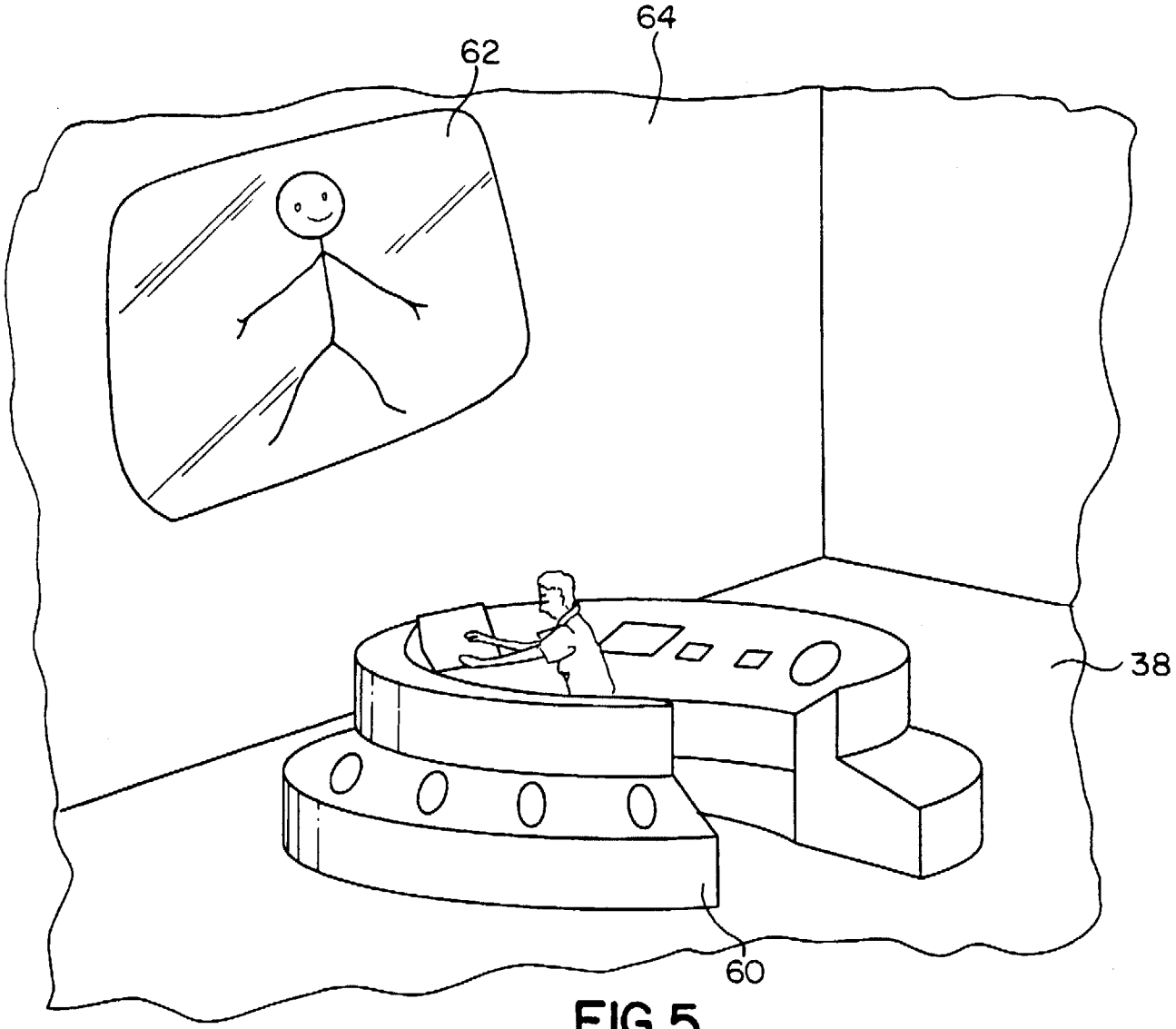
FIG. 5 depicts an art projector area.

FIG. 5 illustrates art projector area 38. A drawing console 60 allows a patron to make a drawing at the console 60 and project an image of it 62 on a projection surface 64.

Figure 6:
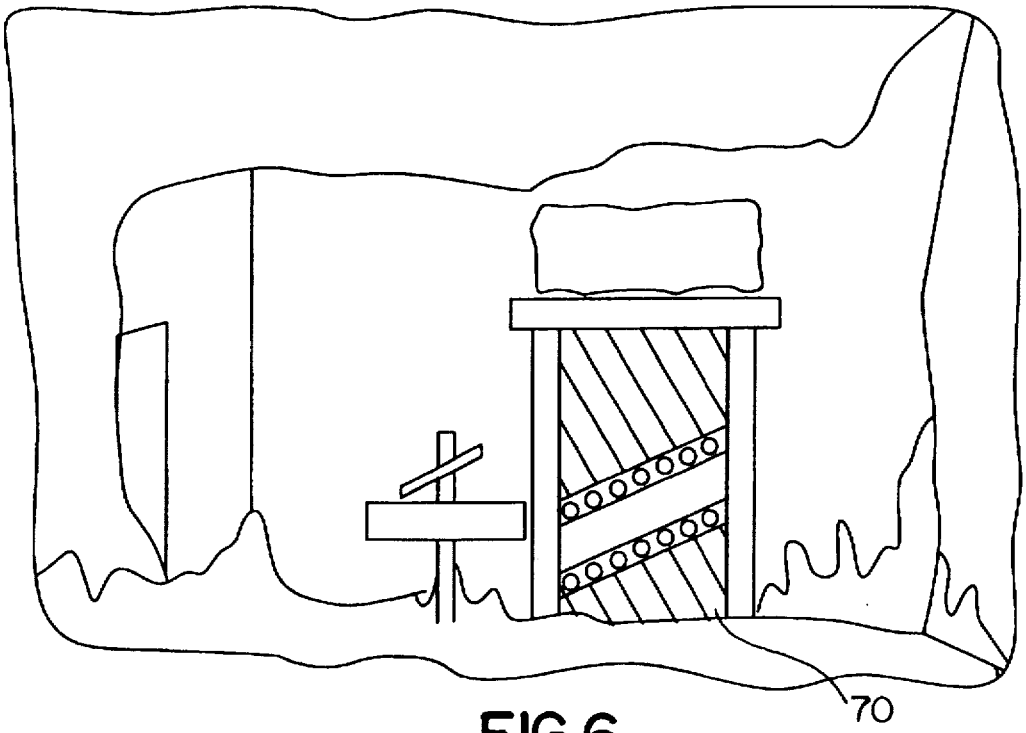
FIG. 6 illustrates a particular embodiment of a mine area.

FIG. 6 illustrates a particular embodiment of the mine area 45 depicted in FIG. 1. A door 70 provides access to mine area 45.

Figure 7:
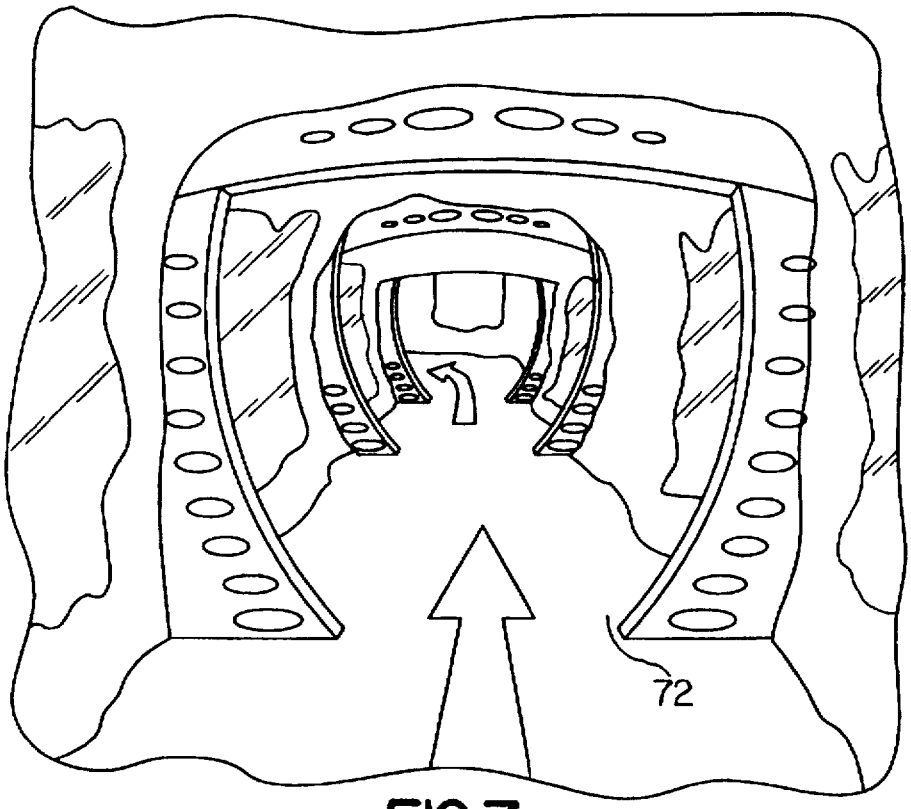
FIG. 7 illustrates one particular embodiment of an interior of a mine area.

FIG. 7 illustrates one particular embodiment of an interior 72 of mine amusement area 45, having futuristically designed support members 74.

Figure 8:
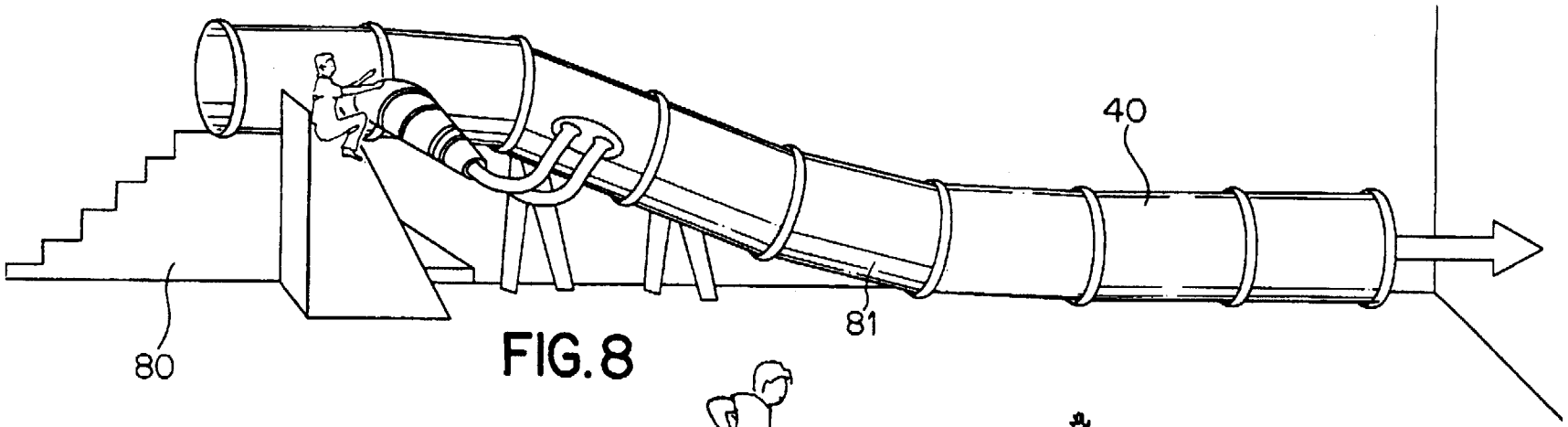
FIG. 8 illustrates a rocket ride.

FIG. 8 illustrates in more detail rocket slide 40, adjacent access steps 80 to slide tube 81.

Figure 9:
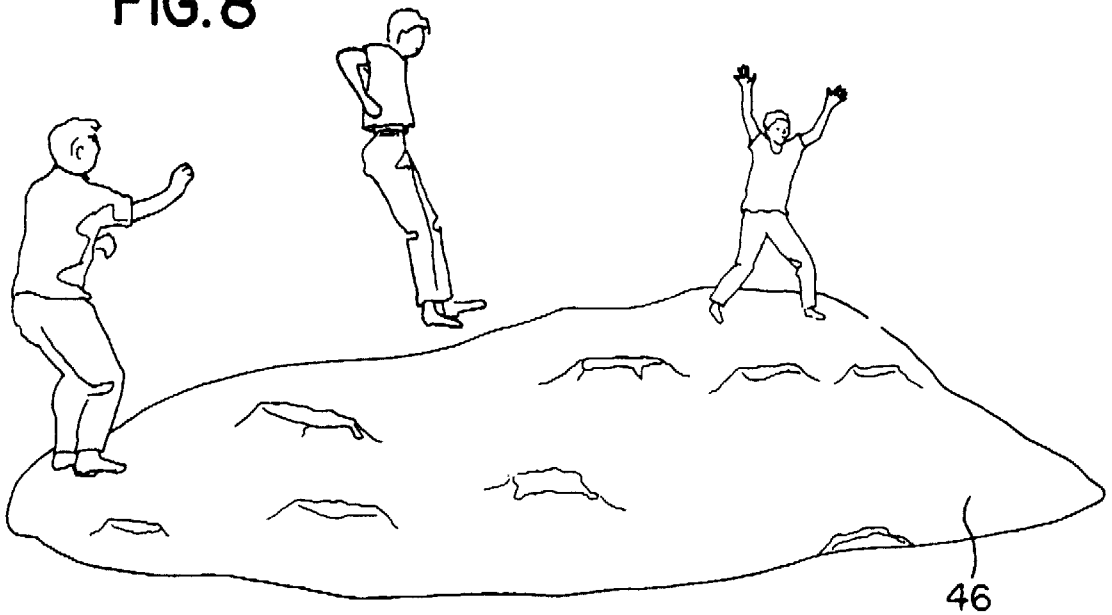
FIG. 9 depicts a moonwalk bounce ride.

FIG. 9 illustrates in more detail moonwalk bounce ride 46.

While the description above refers to particular embodiments of the present invention, it will be understood that many modifications can be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A building structure which houses a restaurant and an amusement area, comprising: a) an enclosed space defining a dining area, further comprising a doorway; b) an enclosed space defining an amusement area, further comprising a doorway: and c) a viewing pane disposed adjacent a wall common to said dining area and said amusement area, whereby patrons of the dining area can view said amusement area and further comprising sound proofing material disposed adjacent said dining area and said amusement area.

2. The building structure of claim 1 further comprising an enclosed space defining a food preparation area accessible to said dining area, a second viewing pane and a means of access between said enclosed space defining a dining area and said enclosed space defining an amusement area.

3. The building structure of claim 1 wherein said amusement area further includes a device selected from the group consisting of a video game and a means for engaging in a virtual reality experience.

4. A building structure which houses a restaurant and an amusement area, comprising: a) an enclosed space defining a dining area, further comprising a doorway: b) an enclosed space defining an amusement area, further comprising a doorway: and c) a viewing pane disposed adjacent a wall common to said dining area and said amusement area, whereby patrons of the dining area can view said amusement area and wherein said enclosed space defining a dining area further comprises slidable walls disposed between a first dining area and a second dining area.

5. The building structure of claim 4 further comprising an enclosed space defining a food preparation area accessible to said dining area, a second viewing pane and i means of access between said enclosed space defining a dining area and said enclosed space defining an amusement area.

6. The building structure of claim 4 wherein said amusement area further includes a device selected from the group consisting of a video game and a means for engaging in a virtual reality experience.

7. A building structure which houses a restaurant and an amusement area, comprising: a) an enclosed space defining a dining area, further comprising a doorway: b) an enclosed space defining an amusement area, further comprising a doorway: and c) a viewing pane disposed adjacent a wall common to said dining area and said amusement area, whereby patrons of the dining area can view said amusement area and wherein said doorway to said space defining an amusement area houses a revolving door.

8. The building structure of claim 7 comprising an enclosed space defining a food preparation area accessable dining area, a second viewing pane and a means of access between said enclosed space defining a dining area and said enclosed space defining an amusement area.

9. The building structure of claim 7 wherein said amusement area further includes a device selected from the group consisting of video games and means for engaging in a virtual reality experience.

10. A building structure which houses a restaurant and an amusement area, comprising: a) an enclosed space defining a dining area, further comprising a doorway: b) an enclosed space defining an amusement area, further comprising a doorway: and c) a viewing pane disposed adjacent a wall common to said dining area and said amusement area, whereby patrons of the dining area can view said amusement area and wherein said building structure contains a lower story and a higher story wherein said amusement area is located on said lower story and said dining area is located on said higher story.

11. The building structure of claim 10 further comprising an enclosed space defining a food preparation area accessible to said dining area, a second viewing pane and a means of access between said enclosed space defining a dining area and said enclosed space defining an amusement area.

12. The building structure of claim 10 wherein said amusement area further includes a device selected from the group consisting of video games and means for engaging in a virtual reality experience.

13. A building structure which houses a restaurant and an amusement area, comprising: a) an enclosed space defining a dining area, further comprising a doorway: b) an enclosed space defining an amusement area, further comprising a doorway: and c) a viewing pane disposed adjacent a wall common to said dining area and said amusement area, whereby patrons of the dining area can view said amusement area and wherein said building structure contains a lower story and a higher story wherein said dining area is located on said lower story and said amusement area is located on said higher story.

14. The building structure of claim 13 further comprising an enclosed space defining a food preparation area accessible to said dining area, a second viewing pane and a means of access between said enclosed space defining a dining area and said enclosed space defining an amusement area.

15. The building structure of claim 13 wherein said amusement area further includes a device selected from the group consisting of video games and means for engaging in a virtual reality experience.

16. A building structure which comprises: a) a first structural member enclosing a food preparation area, a dining area, an amusement area: and a lobby area, said lobby area accessible to an exterior of said building structure, b) a doorway in communication with said amusement area disposed adjacent a second structural member interposed between said lobby area and said amusement area, said amusement area including an amusement park ride housed therein: c) a doorway disposed adjacent said first structural member: d) a third structural member interposed between said dining area and said amusement area: and e) and a viewing pane disposed adjacent said third structural member interposed between said dining area and said amusement area: whereby patrons of said dining area can view said amusement area and further comprising a doorway disposed adjacent said third structural member interposed between said dining area and said amusement area.

17. The building structure of claim 16 further comprising a second viewing pane.

18. The building structure of claim 16 further comprising an area selected from the group consisting of a gift shop a coffee shop, a stage adjacent said amusement area and combinations thereof.

19. The building structure of claim 16 wherein said amusement area further includes a device selected from the group consisting of a video game and a means for engaging in a virtual reality experience.

20. A building structure which comprises: a) a first structural member enclosing a food preparation area, a dining area, an amusement area: and a lobby area, said lobby area accessible to an exterior of said building structure, b) a doorway in communication with said amusement area disposed adjacent a second structural member interposed between said lobby area and said amusement area, said amusement area including an amusement park ride housed therein: c) a doorway disposed adjacent said first structural member: d) a third structural member interposed between said dining area and said amusement area: and e) and a viewing pane disposed adjacent said third structural member interposed between said dining area and said amusement area: whereby patrons of said dining area can view said amusement area and further comprising sound proofing material disposed adjacent said dining area and said amusement area.

21. The building structure of claim 20 further comprising an area selected from the group consisting of a gift shop, a coffee shop a stage adjacent said amusement area and combinations thereof.

22. The building structure of claim 20 wherein said amusement area further includes a device selected from the group consisting of a video game and a means for engaging in a virtual reality experience.

23. The building structure of claim 20 further comprising a second viewing pane.

24. A building structure which comprises: a) a first structural member enclosing a food preparation area, a first dining area, a second dining area, an amusement area: and a lobby area, said lobby area accessible to an exterior of said building structure, b) a doorway in communication with said amusement area disposed adjacent a second structural member interposed between said lobby area and said amusement area, said amusement area including an amusement park ride housed therein, c) a doorway disposed adjacent said first structural member: d) a third structural member interposed between said first dining area, said second dining area and said amusement area: and e) and a viewing pane disposed adjacent said third structural member interposed between said first dining area, said second dining area and said amusement area: whereby patrons of said first and second dining areas can view said amusement area and wherein said first and said second dining area further comprises movable members disposed between said first dining area and said second dining area.

25. The building structure of claim 24 further comprising a second viewing pane.

26. The building structure of claim 24 further comprising an area selected from the group consisting of a gift shop, a coffee shop a stage adjacent said amusement area and combinations thereof.

27. The building structure of claim 24 wherein said amusement area further includes a device selected from the group consisting of video games and means for engaging in a virtual reality experience.

28. A building structure which comprises: a) a first structural member enclosing a food preparation area, a dining area, an amusement area: and a lobby area, said lobby area accessible to an exterior of said building structure, b) a doorway in communication with said amusement area disposed adjacent a second structural member interposed between said lobby area and said amusement area, said amusement area including an amusement park ride housed therein: c) a doorway disposed adjacent said first structural member: d) a third structural member interposed between said dining area and said amusement areas and e) and a viewing pane disposed adjacent said third structural member interposed between said dining area and said amusement area; whereby patrons of said dining area can view said amusement area and wherein said doorway in communication with said amusement area disposed adjacent a second structural member interposed between said lobby area and said amusement area comprises a revolving door.

29. The building structure of claim 28 further comprising a second viewing pane.

30. The building structure of claim 28 further comprising an area selected from the group consisting of a gift shop, a coffee shop a stage adjacent said amusement area and combinations thereof.

31. The building structure of claim 28 wherein said amusement area further includes a device selected from the group consisting of video games and means for engaging in a virtual reality experience.

* * * * *